US008226220B2

(12) United States Patent
Nukui

(10) Patent No.: US 8,226,220 B2
(45) Date of Patent: Jul. 24, 2012

(54) LIQUID DISCHARGE APPARATUS

(75) Inventor: Kosuke Nukui, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 344 days.

(21) Appl. No.: 12/607,131

(22) Filed: Oct. 28, 2009

(65) Prior Publication Data

US 2010/0110152 A1 May 6, 2010

(30) Foreign Application Priority Data

Oct. 30, 2008 (JP) ..... 2008-279784

(51) Int. Cl.
*B41J 2/175* (2006.01)

(52) U.S. Cl. ..... 347/85

(58) Field of Classification Search ..... 347/84, 347/85, 86; 138/95, 118, 120, 158
See application file for complete search history.

(56) References Cited

U.S. PATENT DOCUMENTS 5,053,746 A * 10/1991 Taneo ..... 340/473
5,473,354 A * 12/1995 Arquilevich et al. ..... 347/85
6,068,370 A * 5/2000 Miller et al. ..... 347/85
6,247,802 B1 * 6/2001 Gasso ..... 347/85
6,572,211 B2 * 6/2003 Ootsubo et al. ..... 347/16
2005/0195252 A1 9/2005 Ishikawa et al.
2007/0146445 A1 6/2007 Nukui et al.

FOREIGN PATENT DOCUMENTS

| | | |
|---|---|---|
| JP | 2002-331654 | 11/2002 |
| JP | 2003211691 | 7/2003 |
| JP | 2004-058452 | 2/2004 |
| JP | 2005-246934 | 9/2005 |
| JP | 2007176068 | 7/2007 |

* cited by examiner

*Primary Examiner* — Ahn T. N. Vo
(74) *Attorney, Agent, or Firm* — Frommer Lawrence & Haug LLP

(57) ABSTRACT

A liquid discharge apparatus includes a liquid discharge head which reciprocates in a first direction on a predetermined plane and which discharges the liquids; liquid supply sources which store the liquids; flexible tubes which are arranged in a state of being bent and separated from each other and each of which constructs a part of a liquid flow passage; and a regulating member which is arranged on an outer circumferential side of the bent tubes and which regulates movement of the tubes, and connecting ports of the liquid discharge head, to which first ends of the flexible tubes are connected, are arranged in a second direction on the plane; the tubes are arranged in a third direction intersecting the predetermined plane at fixed portion of the tubes; and the regulating member has accommodating sections which accommodate the flexible tubes respectively.

14 Claims, 12 Drawing Sheets

LIQUID DISCHARGE APPARATUS

CROSS REFERENCE TO RELATED APPLICATION

The present application claims priority from Japanese Patent Application No. 2008-279784 filed on Oct. 30, 2008 the disclosure of which is incorporated herein by reference in its entirety.

BACKGROUND OF THE INVENTION

1. Field of the Invention

The present invention relates to a liquid discharge apparatus for discharging liquids from nozzles.

2. Description of the Related Art

An image recording apparatus described in United States Patent Application Publication No. 2007/0146445 A1 (corresponding to Japanese Patent Application Laid-open No. 2007-176068), which is exemplified as a liquid discharge apparatus for discharging liquids from nozzles, includes an ink-jet head which is movable reciprocatively in the scanning direction and which discharges inks from the nozzles, and ink cartridges which are provided for a main body, and the ink jet head and the ink cartridges are connected to one another by a plurality of flexible tubes, and the plurality of tubes are arranged in a state of being bent so that the plurality of tubes can follow the movement of the ink-jet head. The plurality of tubes have first ends which are connected to the ink jet head respectively in a state of being disposed in the direction perpendicular to the vertical direction and the scanning direction. Further, the plurality of tubes are fixed in a state of being disposed in the vertical direction at predetermined fixed portions which are intermediate portions thereof and which have positions in relation to the perpendicular direction different from those of the first ends connected to the ink-jet head. Accordingly, it is possible to decrease the height of the ink-jet head as compared with a case in which the plurality of tubes are connected to the ink-jet head in a state of being disposed in the vertical direction.

As described in United States Patent Application Publication No. 2007/0146445 A1, the reaction forces, which intend to restore the plurality of tubes from the bent state to the original state, are generated in the plurality of tubes arranged in the bent state. When the plurality of tubes are fixed while being disposed in the vertical direction at the fixed portions and the plurality of tubes are connected to the ink-jet head while being disposed in the direction perpendicular to the vertical direction and the scanning direction, then the reaction forces also act in the vertical direction, because the heights of the plurality of tubes differ between the first ends and the fixed portions respectively. On the other hand, in order to realize the recording of an image on a larger recording paper sheet by using the image recording apparatus described in United States Patent Application Publication No. 2007/0146445 A1, it is necessary that large amounts of the inks should be supplied to the ink-jet head. For this purpose, it is necessary to increase the diameters of the tubes.

Further, if the thickness of the tube is increased in order to avoid the water of the ink contained in the tube to escape to outside and in order to avoid the air to enter the tube from outside, the reaction force, which is generated in the tube, is increased corresponding thereto. It is feared that the tube may float upwardly.

The distances between the fixed portions and the first ends connected to the ink-jet head are different from each other between the plurality of tubes respectively in the vertical direction and the direction perpendicular to the vertical direction. Therefore, the reaction forces, which are generated in the respective tubes, have the directions which are different from each other. The components in the vertical direction of the reaction forces allowed to act on the respective tubes have different magnitudes as well. Therefore, the amounts of the upward floating of the respective tubes are different from each other. It is feared that the tubes may be entangles with each other.

If the plurality of tubes are integrally formed or molded, for example, it is possible to avoid the upward floating of the tubes and the entanglement between the tubes as described above. However, if the plurality of tubes, which are integrally formed or molded as described above, are used, it is difficult to arrange the plurality of tubes such that the tubes are disposed in the vertical direction on the main body side and the tubes are connected to the ink-jet head in the state of being disposed in the direction perpendicular to the scanning direction and the vertical direction, as described in United States Patent Application Publication No. 2007/0146445 A1.

SUMMARY OF THE INVENTION

An object of the present invention is to provide a liquid discharge apparatus which makes it possible to avoid the floating of tubes and the mutual entanglement thereof.

According to a first aspect of the present invention, there is provided a liquid discharge apparatus for discharging liquids; including a liquid discharge head which reciprocates in a first direction on a predetermined plane and which discharges the liquids from nozzles; liquid supply sources which store the liquids to be supplied to the liquid discharge head; a plurality of flexible tubes which are arranged in a state of being bent and separated from each other and each of which constructs a part of a liquid flow passage from one of the liquid supply sources to the liquid discharge head; and a regulating member which is arranged on an outer circumferential side of the bent tubes and which regulates movement of the tubes, and a plurality of connecting ports, of the liquid discharge head, to which first ends of the flexible tubes are connected respectively, are arranged in a second direction on the predetermined plane; the tubes are fixed to the liquid discharge apparatus at fixed portions of the tubes in a state that the tubes are arranged in a third direction intersecting the predetermined plane, the fixed portions being located at positions different from positions of the connecting ports of the liquid discharge head in relation to a direction which is perpendicular to the first direction and parallel to the predetermined plane; and the regulating member has a plurality of accommodating sections which accommodate the flexible tubes respectively.

When the connecting ports of the liquid discharge head, which are connected to the tubes, are disposed in the second direction parallel to the predetermined plane, and the tubes are fixed at the intermediate fixed portions in the state of being disposed in the third direction, then the reaction forces, which intend to restore the bent tubes to the original state, act in the third direction, and it is feared that the tubes may be allowed to float upwardly (moved) in the third direction.

However, in the present invention, the regulating member has the plurality of accommodating sections which accommodate the plurality of tubes respectively. Therefore, it is possible to avoid the upward floating of the tubes in the third direction.

If one accommodating section is formed for the plurality of tubes, it is possible to avoid the upward floating of the tubes. However, the plurality of tubes are separated from each other, and the distances between the first ends and the fixed portions are different from each other in the third direction and the direction perpendicular to the first direction. Therefore, the directions of the reaction forces allowed to act on the respective tubes are changed, and the magnitudes of the components in the third direction of the reaction forces allowed to act on the respective tubes are also different from each other. It is feared that the amounts of the upward floating may differ among the tubes, and it is feared that the tubes may be entangles with each other, because the magnitudes of the components in the third direction of the reaction forces allowed to act on the respective tubes are different from each other.

In the present invention, each of the accommodating sections is associated with one of the tubes. Therefore, it is possible to avoid the upward floating of the tubes, while avoiding the mutual entanglement of the tubes. The term "second direction" means any direction on the predetermined plane, which includes the first direction and the direction perpendicular to the first direction as well.

DESCRIPTION OF THE PREFERRED EMBODIMENTS

A preferred embodiment of the present invention will be explained below.

Figure 1:
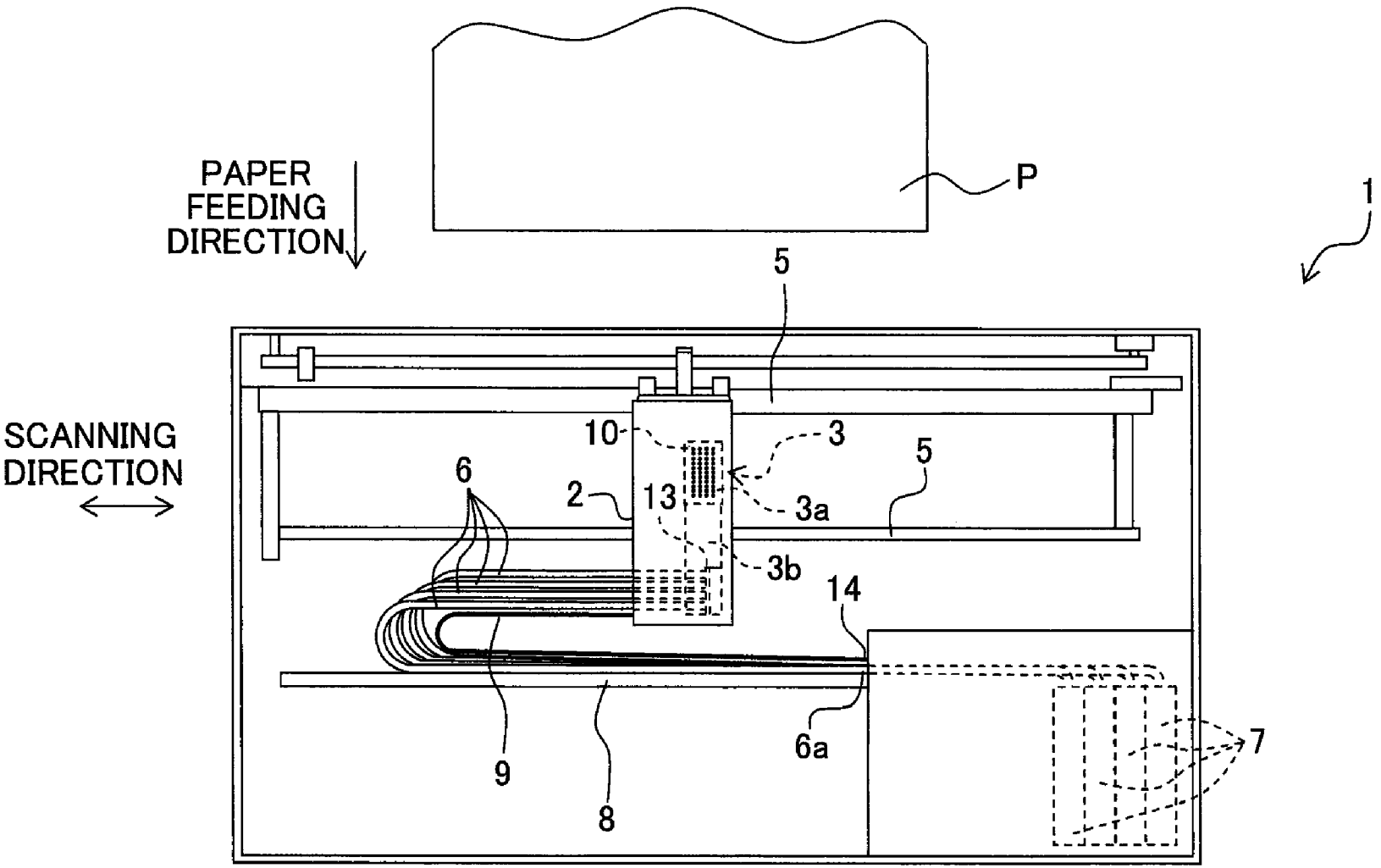
FIG. 1 shows a schematic arrangement of a printer according to an embodiment of the present invention.

As shown in FIG. 1, a printer 1 (liquid discharge apparatus) includes, for example, a carriage 2, an ink-jet head 3 (liquid discharge head), four tubes 6, four ink cartridges 7, a tube guide 8, and a flexible flat cable (FFC) 9 (flexible wiring member).

Two guide shafts 5 are arranged in parallel to one another along the horizontal plane (predetermined plane) in the printer 1. The carriage 2 is movable reciprocatively in the scanning direction (left-right direction as viewed in FIG. 1, first direction) along the two guide shafts 5. The ink jet head 3 has a main head body 3*a* and a subtank unit 3*b*. The main head body 3*a* is arranged on the lower surface of the carriage 2. Nozzles 10 are formed on the lower surface of the main head body 3*a*. A recording paper sheet P is transported in the paper feeding direction (in the downward direction as viewed in FIG. 1) by an unillustrated recording paper transport mechanism. The inks are discharged from the nozzles 10 of the ink-jet head 3 which is moved in the scanning direction together with the carriage 2. Accordingly, the printing is performed on the recording paper sheet P.

Unillustrated subtanks, which are provided to temporarily store the inks to be supplied to the head body 3*a*, are arranged in the subtank unit 3*b*. Further, the subtank unit 3*b* is formed with, for example, unillustrated ink flow passages connected to the subtanks. The subtank unit 3*b* is connected to the main head body 3*a*, and the subtank unit 3*b* extends downwardly as viewed in FIG. 1 from portions at which the subtank unit 3*b* is connected to the main head body 3*a*. Four connecting ports 3*c*, which are disposed in the paper feeding direction (in the upward-downward direction as viewed in FIG. 1, second direction along the horizontal plane), are provided at lower end portions of the subtank unit 3*b* as shown in FIG. 1. First ends of the tubes 6 are connected to the four connecting ports 3*c* respectively. Accordingly, the inks to be discharged from the nozzles 10 are supplied from the tubes 6 to the ink-jet head 3 as described later on.

The four ink cartridges 7 (liquid supply sources) are arranged at lower-right end portions of the printer 1 as viewed in FIG. 1, and they are disposed in the scanning direction. The inks of black, yellow, cyan, and magenta are stored in the four ink cartridges 7 respectively. The other ends or second ends of the tubes 6 are connected thereto. Accordingly, the inks, which are stored in the ink cartridges 7, are supplied to the ink-jet head 3 via the tubes 6.

The tube guide 8 is a member provided to prevent the tubes 6 for connecting the ink-jet head 3 and the ink cartridges 7 from being curved toward the downstream side in the paper feeding direction (in the downward direction as viewed in FIG. 1) in accordance with the reciprocative movement of the carriage 2. Therefore, the tube guide 8 extends in the scanning direction, and the tube guide 8 is arranged adjacent to the tubes 6 on the downstream side in the paper feeding direction.

FFC 9 is provided in order to apply, for example, the driving electric potential to the ink-jet head 3. FFC 9 is arranged adjacent to the tubes 6 on the inner circumferential side of the bending of the tubes 6 as viewed in a plan view, and FFC 9 extends in a state of being bent along the tubes 6.

Next, the structures of the tubes 6 and the tube guide 8 in this embodiment will be explained in detail below.

The tube 6 is composed of a flexible material such as a synthetic resin including, for example, low density polyethylene. The cross section of the tube 6, which relates to the direction perpendicular to the extending direction thereof, has a substantially circular external shape (the term, which is hereinafter simply referred to as "cross section of the tube 6", refers to the cross section in relation to the concerning direction). The cross section of the space formed in the tube 6 in relation to the concerning direction is also circular. In other words, the cross section of the tube 6 is concentric. As for the tube in which the black ink is flowed, the inner diameter is about 1.6 mm, and the outer diameter is about 2.4 mm. As for each of the tubes in which each of the color inks other than the black is flowed, the inner diameter is about 1.25 mm, and the outer diameter is about 2.15 mm.

As shown in FIG. 1, the first ends of the tubes 6 are connected to the connecting ports 3*c* of the ink-jet head 3, and the tubes 6 extend from the connecting ports 3*c* in the leftward direction as viewed in FIG. 1. The tubes 6 are curved by about 180°, and the tubes 6 extend in the rightward direction as viewed in FIG. 1. As described above, the other ends or second ends thereof are connected to the ink cartridges 7. In other words, the tubes 6 are extending from the first ends in the leftward direction as viewed in FIG. 1, and are bent back in a U-shape in the middle of the tubes 6. The reason, why the tubes 6 are arranged while being bent as described above in this arrangement, is that it is intended to allow the tubes 6 to follow the carriage 2 when the carriage 2 is moved reciprocatively in the scanning direction.

The tubes 6 are arranged in the vertical direction (third direction intersecting the predetermined plane) at fixed portions 6*a* which are portions (portions positioned at intermediate positions) between the bent portions and the ink cartridges 7. Further, the tubes 6 are fixed while being interposed between a fixing member 14 and the tube guide 8.

Figure 2:
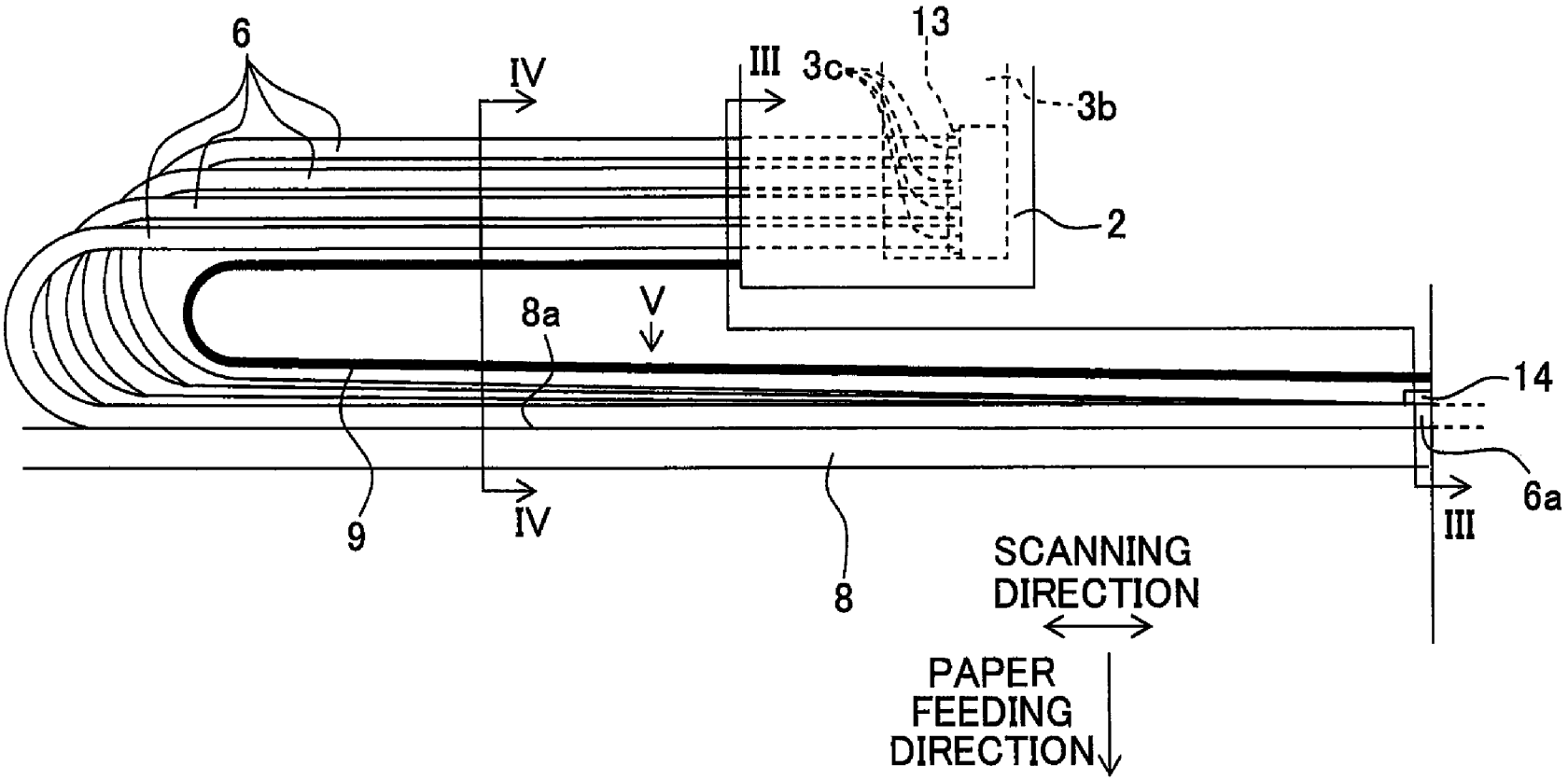
FIG. 2 shows a partial magnified view illustrating those disposed in the vicinity of tubes shown in FIG. 1.

In this arrangement, as shown in FIGS. 1 and 2, all of the fixed portions 6*a* of the tubes 6 are positioned on the downstream side in the paper feeding direction as compared with the connecting ports 3*c* of the ink-jet head 3 (positions of the fixed portions 6*a* in relation to a direction, which is perpendicular to the first direction and parallel to the predetermined plane, are different from those of the connecting ports 3*c*). The fixed portions 6*a* are positioned over or above the connecting ports 3*c* of the ink-jet head 3 in relation to the vertical direction. In other words, the connecting ports 3*c* of the ink-jet head 3 are arranged below the lowermost position of the fixed portion 6*a*. Alternatively, the connecting ports 3*c* of the ink jet head 3 may be arranged at the same height as that of the lowermost position of the fixed portion 6*a*.

Figure 3:
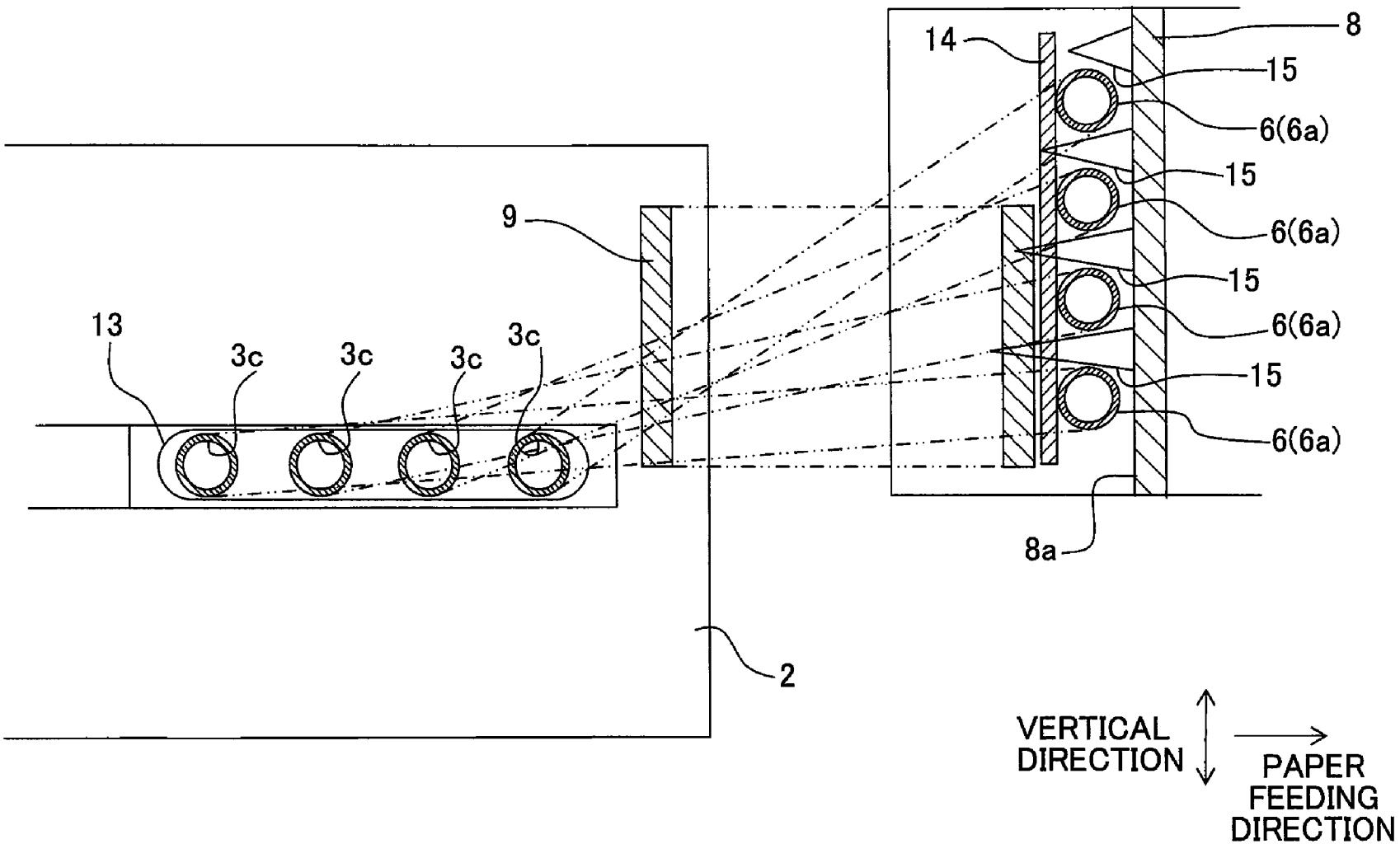
FIG. 3 shows a sectional view taken along a line shown in FIG. 2.

As shown in FIGS. 1 to 3, the four tubes 6 are fixed in a state of being mutually bundled by a connecting section 13 at the first ends thereof which are connected to the connecting ports 3*c* of the ink jet head 3. Accordingly, the four tubes 6 can be connected to the connecting ports 3*c* at once, and the tubes 6 can be easily connected to the connecting ports 3*c*. The four tubes 6 are not mutually bundled (separated from each other) at the portions disposed between the first ends thereof and the fixed portions 6*a*, and they are deformable independently.

Further, the tube 6, which is included in the four tubes 6 and which is positioned more upwardly at the fixed portion 6*a*, is connected to the connecting port 3*c* which is positioned on the inner circumferential side (downstream side in the paper feeding direction as viewed in FIG. 1) of the bending of the tube 6 as viewed in a plan view, i.e., the connecting port 3*c* which is nearest to the fixed portion 6*a* in relation to the paper feeding direction (upward-downward direction as viewed in FIG. 1). In other words, a first tube 6, among the tubes 6, of which fixed portion 6*a* is positioned at an upper position than that of a second tube 6, among the tubes 6, is connected to a first connecting port 3*c*, among the connecting ports 3*c*, positioned nearer to the fixed portions 6*a* than a second connecting port 3*c*, among the connecting ports 3*c*, to which the second tube 6 is connected. The lengths of the four tubes 6 are approximately identical with each other in order that the flow passage resistances of the inks are uniformized. Therefore, as shown in FIGS. 1 to 4, the four tubes 6 are arranged so that the tube 6, which is positioned more downwardly, has the portion which is disposed between the first end of the tube 6 and the fixed portion 6*a* and which is positioned on the outer circumferential side of the bending of the tube 6 as viewed in a plan view.

In the embodiment of the present invention, as described above, the four tubes 6 are separated from each other at the portions disposed between the connecting ports 3*c* and the fixed portions 6*a*, and they are deformable independently. Therefore, even when the lengths of the four tubes 6 are identical with each other, the tubes 6 can be arranged in a twisted state so that the tube 6, which has the fixed portion 6*a* positioned more upwardly (on the other side), is connected to the connecting port 3*c* which is positioned on the inner circumferential side of the bending of the tube 6 as viewed in a plan view, i.e., on the downstream side in the paper feeding direction.

Unlike this embodiment, if the connecting ports 3*c* of the ink-jet head 3 are disposed in the vertical direction in conformity with the arrangement of the fixed portions 6*a*, the tubes 6 can be connected to the connecting ports 3*c* without allowing the tubes 6 to be in the twisted state as described above. However, in this case, the length of the ink jet head 3 (subtank unit 3*b*) in relation to the vertical direction is increased.

In the embodiment of the present invention, the connecting ports 3*c* of the ink-jet head 3 are disposed in the paper feeding direction. Therefore, it is possible to decrease the length of the ink jet head 3 in relation to the vertical direction. In this arrangement, it is necessary that the tubes 6 should be in the twisted state as described above in order that the tubes 6, which are arranged in the vertical direction at the fixed portions 6*a*, are connected to the connecting ports 3*c* which are arranged in the paper feeding direction.

Figure 8:
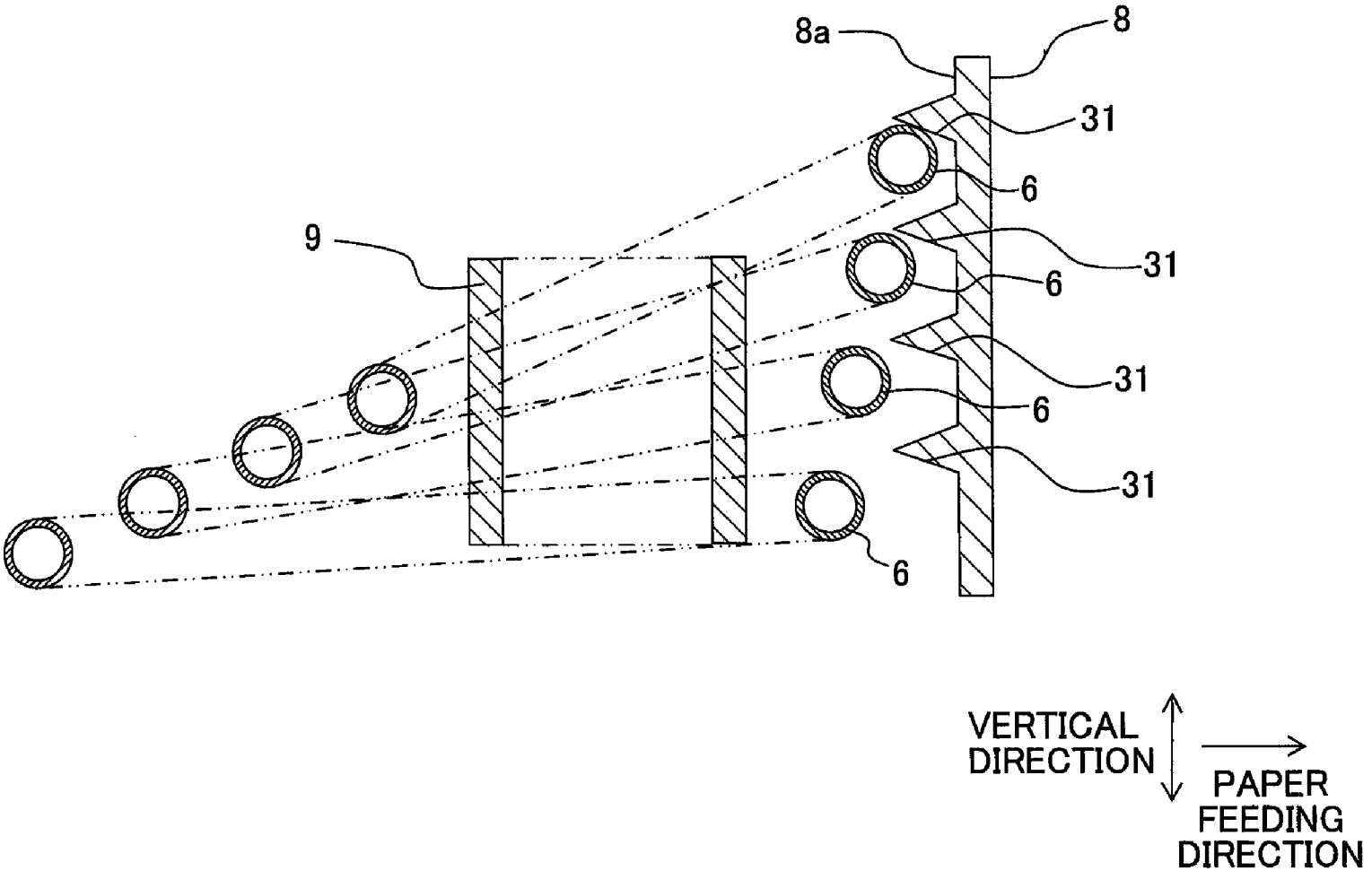
FIG. 8 shows a view of a second modified embodiment corresponding to FIG. 4.

The tube guide 8 is composed of, for example, a synthetic resin material. The tube guide 8 is arranged adjacently on the lower side of the tubes 6 as viewed in FIG. 1 (on the outer circumferential side in the bending direction of the tubes 6 as viewed in a plan view). The tube guide 8 extends in the scanning direction. Further, the upper surface of the tube guide 8 shown in FIG. 8 is the opposing surface 8*a* which extends in the scanning direction and the vertical direction. The portions of the tubes 6, which are disposed in the vertical direction between the bent portions and the fixed portions 6*a* (portions of the tubes 6 extending toward the first ends of the tubes 6 from the fixed portions 6*a* and disposed in the third direction), are abutted on the opposing surface 8*a* while being opposed thereto. Accordingly, the tubes 6 are regulated for the spread which would be otherwise caused such that the portions of the tubes 6 opposed to the opposing surface 8*a* are moved downwardly as viewed in FIG. 1 (in the direction perpendicular to the first direction and parallel to the predetermined plane) by the reaction forces F1 to F4 generated by the bending of the tubes 6 as described later on.

Figure 4:
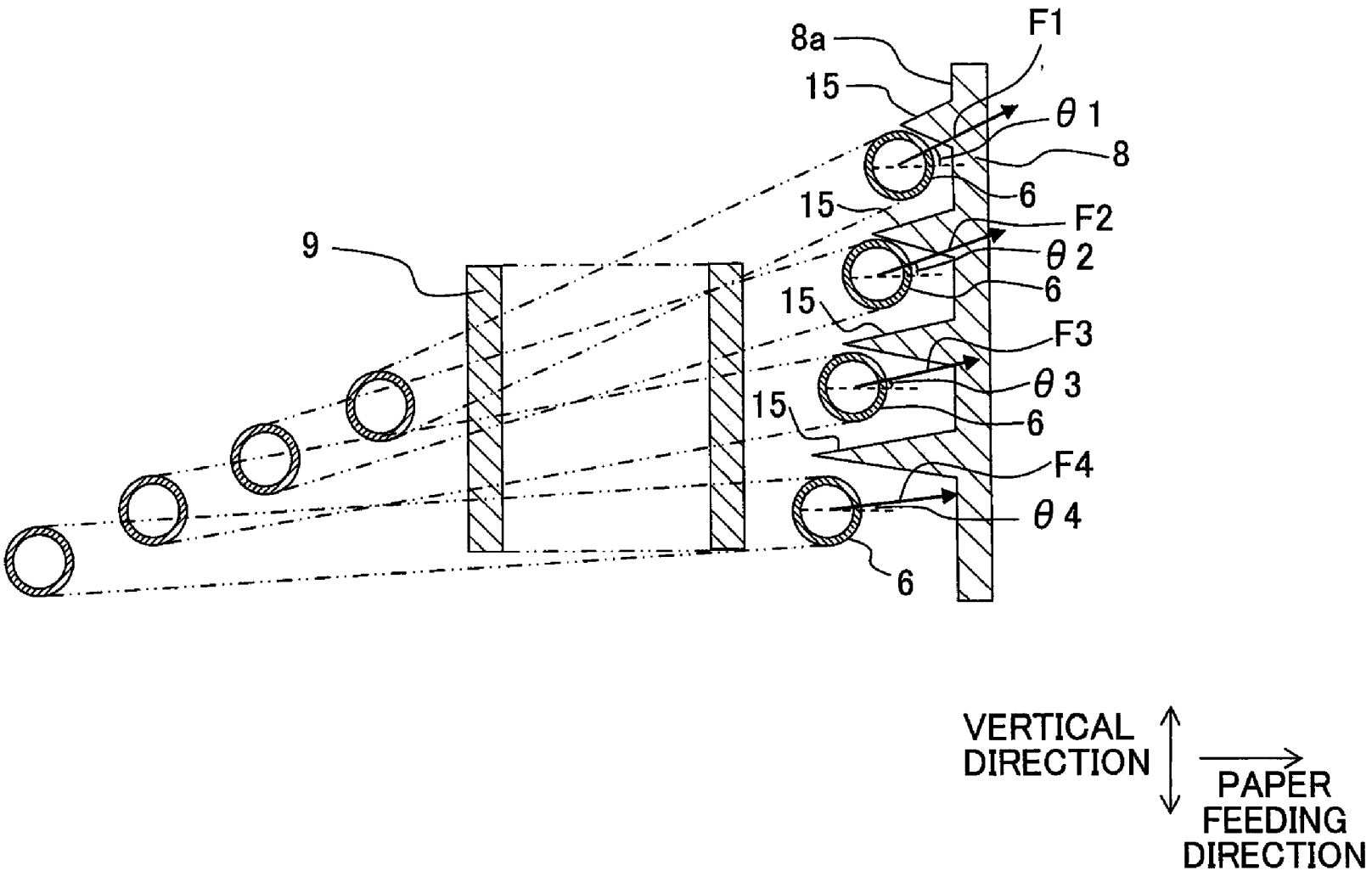
FIG. 4 shows a sectional view taken along a line IV-IV shown in FIG. 2.

As shown in FIGS. 3 and 4, four ribs 15 are formed on the opposing surface 8*a* of the tube guide 8 corresponding to the four tubes 6. The ribs 15 protrude to the upstream side in the paper feeding direction from the portions of the opposing surface 8*a* adjacent to the upper portions of the fixed portions 6*a* of the four tubes 6 in relation to the vertical direction respectively. Each of the ribs 15 has tapered shape in which the width in relation to the vertical direction are decreased at positions nearer to the end portions or forward ends. The ribs 15, which are positioned more downwardly, protrude more greatly from the opposing surface 8*a*. In other words, a first rib 15, among the ribs 15, positioned at a lower position than a second rib 15, among the ribs 15, protrudes more greatly from the opposing surface 8*a* than the second rib 15. The tube guide 8, which is formed with the ribs 15 as described above, can be formed, for example, by means of the resin molding. In this embodiment, the rib 15, which is positioned at the uppermost position in relation to the vertical direction, protrudes by about 2.4 mm from the opposing surface 8*a*, while the rib 15, which is positioned at the lowermost position, protrudes by about 20 mm from the opposing surface 8*a*. In this way, four accommodating sections, in which the four tubes 6 are accommodated respectively, are defined in the tube guide 8 by the opposing surface 8*a* and the four ribs 15 protruding from the opposing surface 8*a*.

In this arrangement, the tubes 6 are bent at the portions disposed between the connecting ports 3*c* and the fixed portions 6*a* as described above. Therefore, as shown in FIG. 4, the reaction forces F1 to F4, which intend to restore the tubes 6 from the bent state to the original state, are generated in the tubes 6 respectively. In this embodiment, the connecting ports 3*c* of the ink-jet head 3, to which the first ends of the tubes 6 are connected, are positioned at the heights which are mutually different from those of the fixed portions 6*a* of the tubes 6. Therefore, the reaction forces F1 to F4 act not only in the direction parallel to the horizontal plane (in at least one of the scanning direction and the paper feeding direction) but also in the vertical direction.

In the case of the printer 1 which performs the printing by discharging the inks from the nozzles 10 of the ink-jet head 3, for example, when it is intended to realize the printing on a large recording paper sheet P, it is necessary that the amounts of the inks to be supplied to the ink-jet head 3 should be increased. For this purpose, it is necessary to increase the diameters of the tubes 6.

When the diameters of the tubes 6 are increased, then the reaction forces F1 to F4 described above are increased as well, and it is feared that the tubes 6 may float upwardly (may be moved in the third direction).

However, in the embodiment of the present invention, the ribs 15 are formed on the opposing surface of the tube guide 8 against which the tubes 6 are allowed to abut. Therefore, it is possible to avoid (regulate) the upward floating of the tubes 6 owing to the contact of the tubes 6 with the ribs 15.

In such a situation, if only the rib 15, which is positioned at the uppermost position and which is included in the four ribs 15, is provided unlike the embodiment of the present invention, it is possible to avoid the upward floating of the tubes 6 as described above. However, the four tubes 6 are not fixed to one another at the portions disposed between the connecting ports 3*c* and the fixed portions 6*a*, and they are deformable independently. Further, the reaction forces F1 to F4, which are generated in the tubes 6, have different angles θ1 to θ4 which are formed with respect to the horizontal direction as shown in FIG. 4. When the angles θ1 to θ4 are different from each other, the magnitudes of the components in the vertical direction of the reaction forces F1 to F4 are different from each other. Therefore, the upward floating amounts of the four tubes 6 are different from each other. As a result, it is feared that the tubes 6 may be entangled with each other.

On the contrary, in the embodiment of the present invention, the ribs 15 are individually provided corresponding to the four tubes 6. Accordingly, the four tubes 6 are brought in contact with the corresponding ribs 15 respectively. Therefore, it is possible to avoid the upward floating of the tubes 6, and it is possible to avoid the mutual entanglement of the tubes 6.

Figure 5:
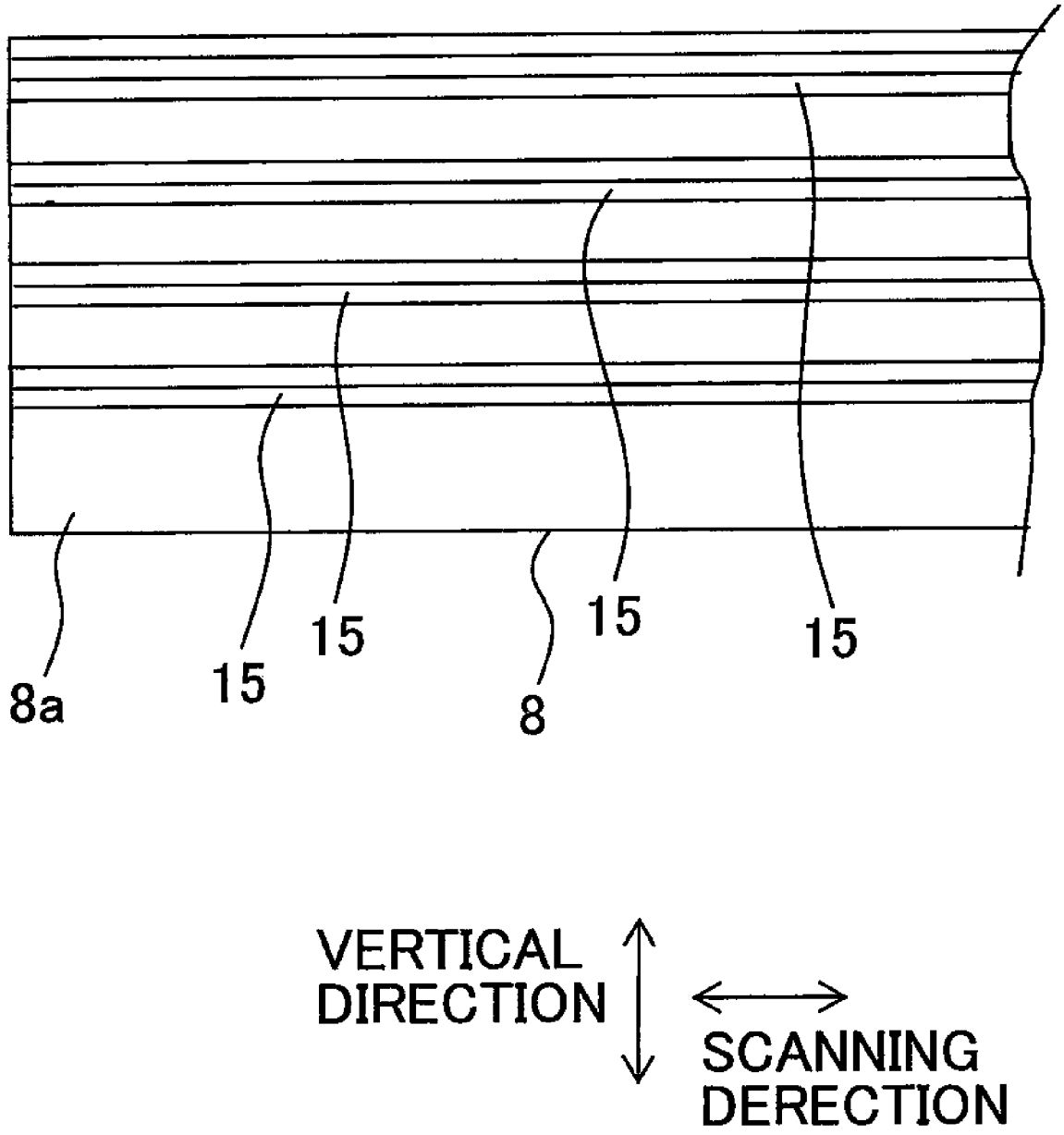
FIG. 5 shows a view as viewed in a direction of an arrow V shown in FIG. 2.

As described above, the four tubes 6 are arranged such that a tube 6, among the tubes 6, of which fixed portion 6*a* is positioned more downwardly, is connected to a connecting port 3*c*, among the connecting ports 3*c*, positioned farther from the fixed portion 6*a* in the paper feeding direction, i.e., positioned on the more upstream side in the paper feeding direction (positioned on the outer circumferential side of the bending of the tubes 6 as viewed in a plan view). Therefore, the tubes 6, which have the fixed portions 6*a* positioned more downwardly, are separated more greatly from the opposing surface 8*a*. On the other hand, the ribs 15, which are positioned more downwardly, protrude more greatly from the opposing surface 8*a*. Therefore, as shown in FIG. 5, the four tubes 6 are reliably brought in contact with the corresponding ribs 15 (for example, in FIG. 5, the four tubes 6 are brought in contact with the corresponding ribs 15 over the approximately identical lengths). Accordingly, it is possible to avoid the upward floating of the tubes 6 and the mutual entanglement of the tubes.

Unlike the embodiment of the present invention, even if the ribs 15 have constant widths in relation to the vertical direction, it is also possible to avoid the upward floating of the tubes 6 and the mutual entanglement of the tubes 6 as described above. However, in this case, it is necessary that the spacing distances between the ribs 15 should be larger than the diameters of the tubes 6 in order to successfully position the tubes 6 between the adjoining ribs 15. As a result, it is feared that the tube guide 8 may be large-sized.

On the contrary, in the embodiment of the present invention, each of the ribs 15 has the tapered shape in which the width in relation to the vertical direction is decreased toward the end portions. Therefore, it is enough for the ribs 15 that the spacing distances, which are provided at least in the vicinity of the end portions to be brought in contact with the tubes 6, are larger than the diameters of the tubes 6. It is enough that the spacing distances between the ribs 15, which are provided on the opposing surface 8*a*, are smaller than the diameters of the tubes 6. Accordingly, it is possible to decrease the spacing distances between the ribs 15. It is possible to prevent the tube guide 8 from being large-sized.

In the printer 1, when the printing operation as described above is repeatedly performed in a high temperature situation, the tubes 6 are softened. Therefore, a situation arises such that the tubes 6 hang down especially when the carriage 2 is moved to the position near to the right side end of the printer 1 as viewed in FIG. 1, and the tubes 6 are in such a state that the tubes 6 begin to be separated from the opposing surface 8*a* of the tube guide 8 at the positions near to the fixed portions 6*a*.

In such a situation, if the four tubes 6 are arranged such that a tube 6, among the tubes 6, of which fixed portion 6*a* is positioned more upwardly, is connected to a connecting port 3*c* which is positioned on the outer circumferential side of the bending of the tubes 6 as viewed in a plan view, i.e., on the upstream side in the paper feeding direction in contrast to the embodiment of the present invention, the connecting port 3*c*, which is connected to the tube 6 positioned at the uppermost position at the fixed portion 6*a*, is greatly separated from the fixed portion 6*a* in relation to the paper feeding direction as compared with the arrangement of the embodiment of the present invention. Therefore, the angle θ1 is decreased with respect to the paper feeding direction in relation to the direction of the reaction force F1 generated in the tube 6 which is positioned at the uppermost position at the fixed portion 6*a*. The component in the vertical direction of the reaction force F1 is decreased as compared with the arrangement of the embodiment of the present invention. Therefore, the tube 6, which is positioned at the uppermost position at the fixed portion 6*a*, greatly hangs down, and the tube 6 pushes the other three tubes 6 downwardly. As a result, it is feared that the tubes 6 may be brought in contact with any portion of the printer 1.

On the contrary, in the embodiment of the present invention, the tube 6, which is included in the four tubes 6 and which is positioned more upwardly at the fixed portion 6*a*, is connected to the connecting port 3*c* which is positioned on the inner circumferential side of the bending of the tubes 6 as viewed in a plan view. Therefore, the component in the vertical direction of the reaction force F1 generated in the tube 6 positioned at the uppermost position at the fixed portion 6*a* is increased to some extent, while the reaction forces F1 to F4, which are generated in the respective tubes 6 as described above, are decreased. Therefore, it is possible to prevent the other three tubes 6 from being pushed downwardly, which would be otherwise caused by the concerning tube 6 allowed to hang downwardly.

Next, an explanation will be made about modified embodiments in which various modifications are applied to the embodiment of the present invention. However, those constructed in the same manner as the embodiment of the present invention are designated by the same reference numerals, any explanation of which will be appropriately omitted.

Figure 6:
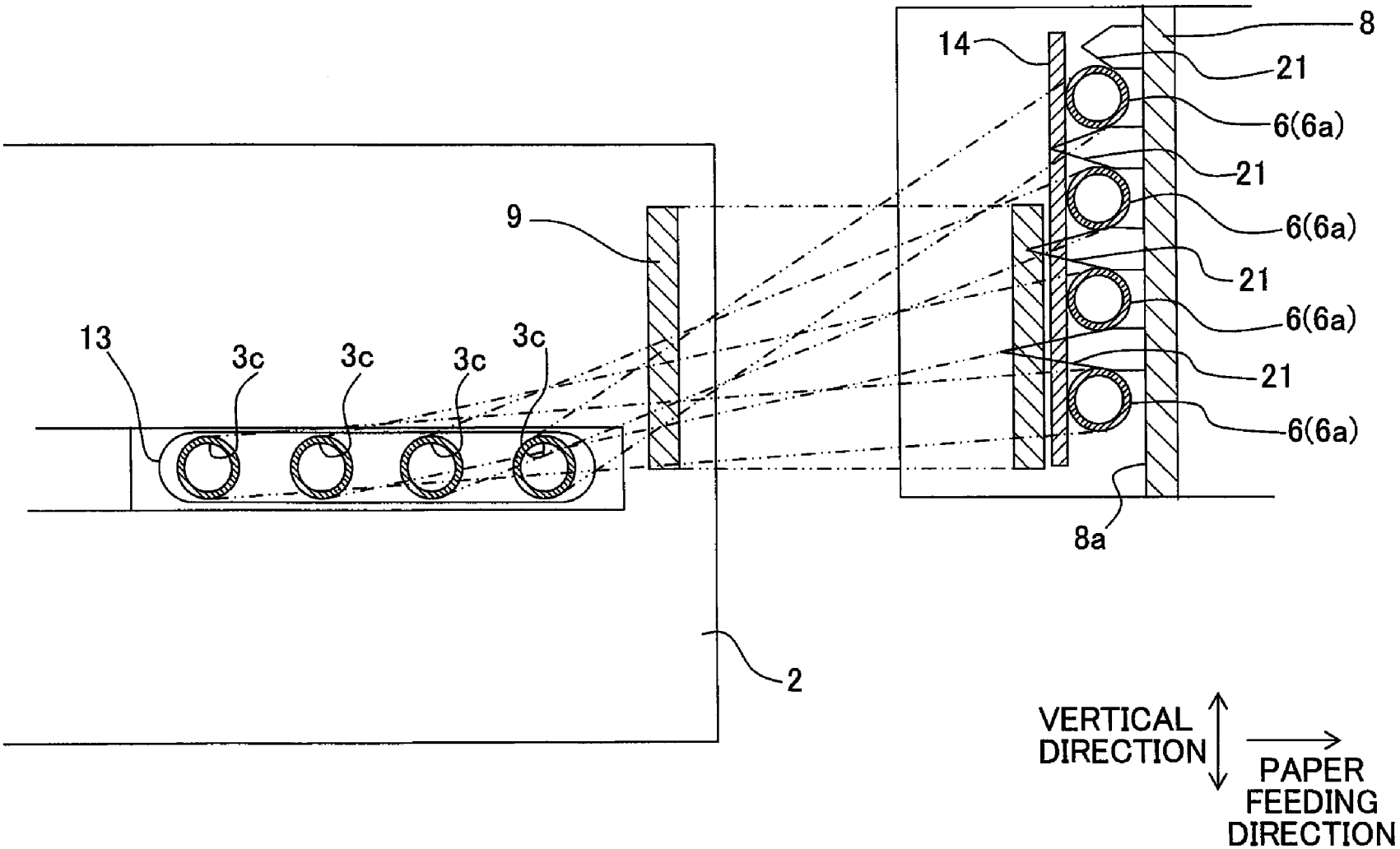
FIG. 6 shows a view of a first modified embodiment corresponding to FIG. 3.
Figure 7:
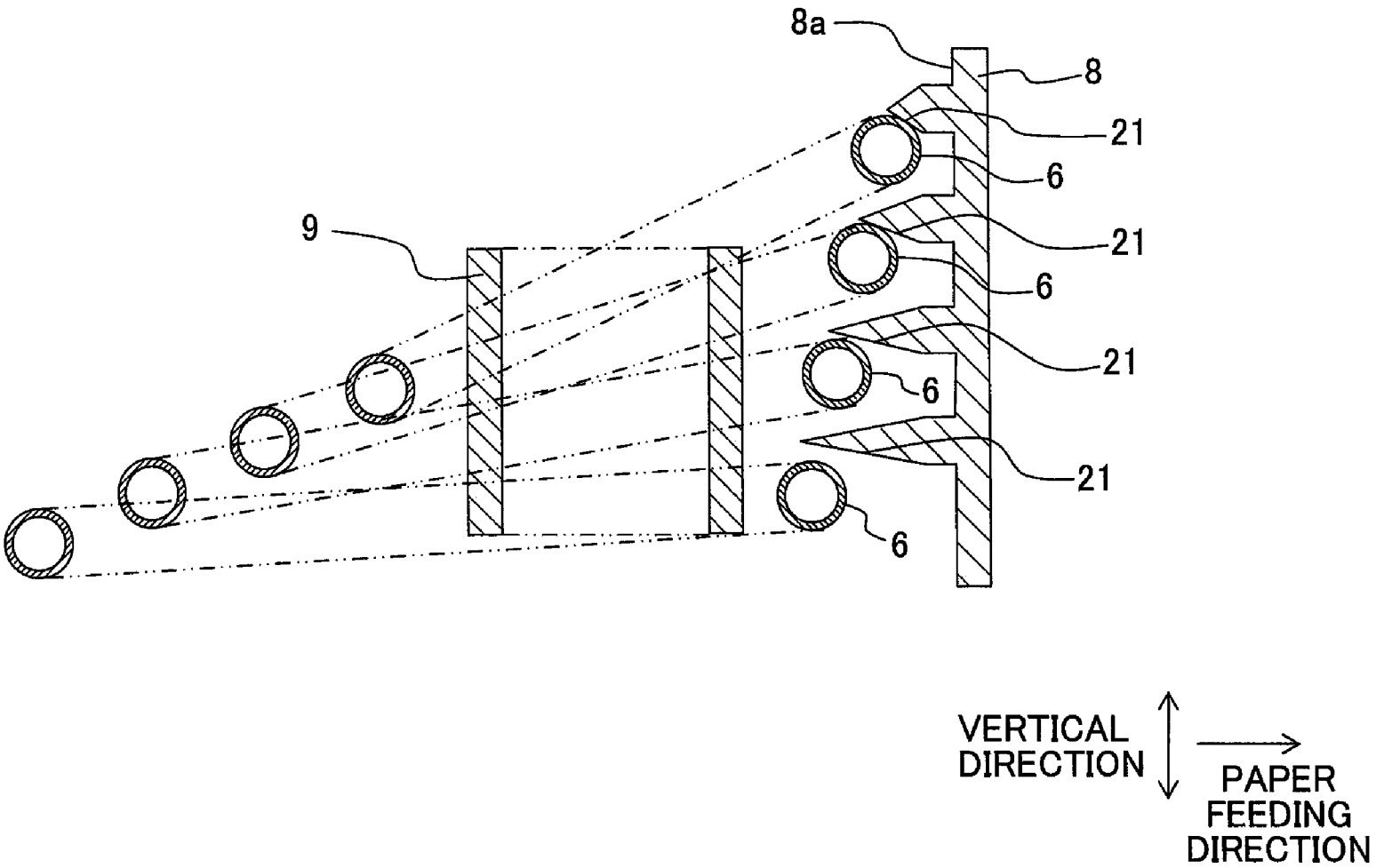
FIG. 7 shows a view of the first modified embodiment corresponding to FIG. 4.

In one modified embodiment, as shown in FIGS. 6 and 7, ribs 21 extend from the opposing surface 8*a* so that the widths in relation to the vertical direction are constant. Further, each of the ribs 21 has a tapered shape at the end portion thereof so that the width in relation to the vertical direction is decreased in a direction away from the opposing surface 8*a*. That is, each of the ribs 21 has the tapered shape at the end portion thereof so that the width in relation to the vertical direction is decreased in the direction away from the opposing surface 8*a*, and has a constant width in relation to the vertical direction at a portion different from the end portions (first modified embodiment).

When the tube guide 8 formed with the ribs are manufactured by means of, for example, the resin molding, it is feared that the tube guide 8 having the ribs may be difficult to be manufactured, if the length of each of the ribs protruding from the opposing surface 8*a* is large, when each of the ribs 15 (see FIG. 4) entirely has the tapered shape in which the width in relation to the vertical direction is decreased in a direction away from the opposing surface 8*a* as in the embodiment of the present invention.

However, in the first modified embodiment, the width of each of the ribs 21 in relation to the vertical direction is substantially constant at a portion different from the end portion. Therefore, even when the tube guide 8, which has the ribs 21 greatly protruding from the opposing surface 8*a*, is manufactured by means of the resin molding, the tube guide 8*a* can be easily manufactured.

Figure 9:
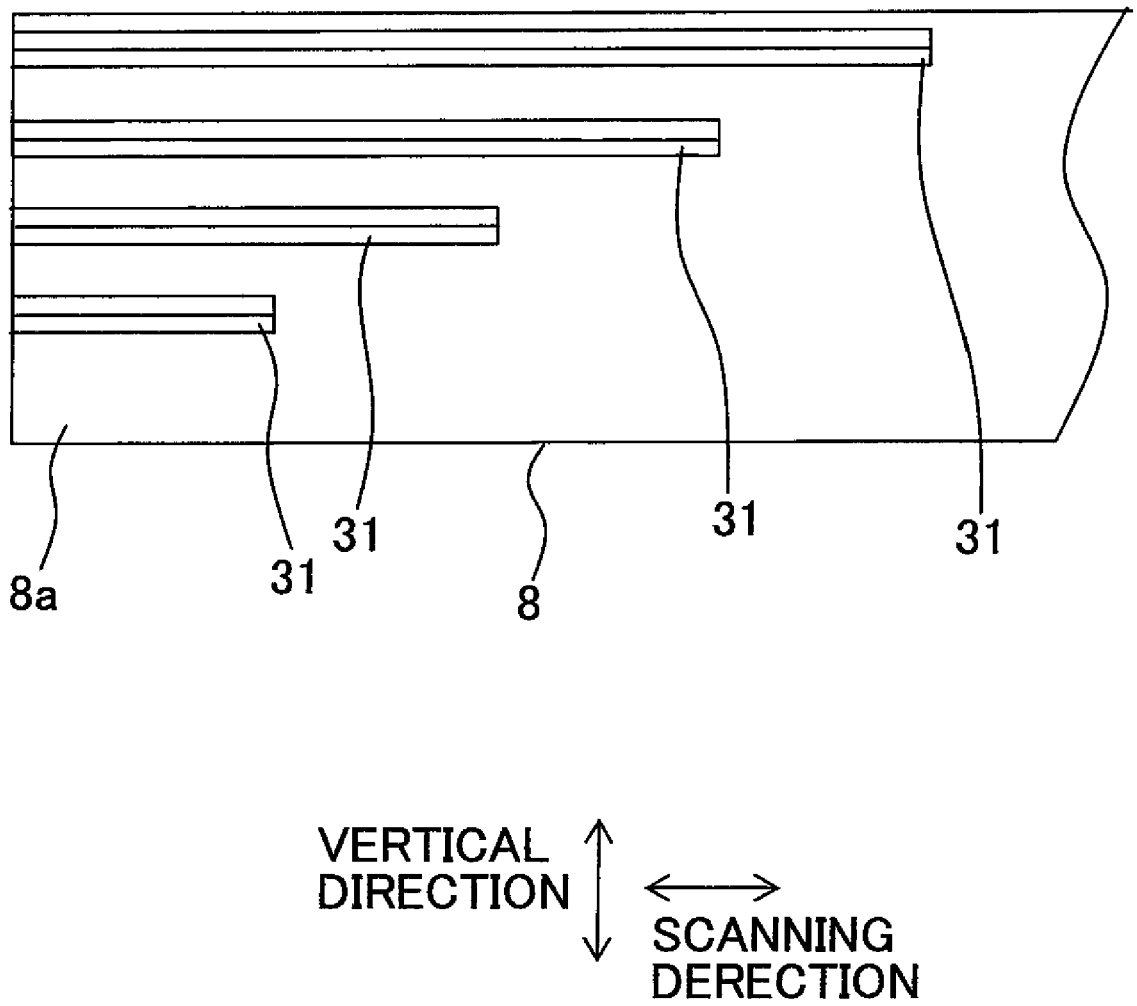
FIG. 9 shows a view of the second modified embodiment corresponding to FIG. 5.

In another modified embodiment, the lengths of ribs 31 protruding from the opposing surface 8*a* toward the upstream side in the paper feeding direction are approximately same with each other as shown in FIG. 8, but a rib 31, among the ribs 31, which is positioned more upwardly, extends longer in the scanning direction than another rib 31 located below the rib 31 as shown in FIG. 9. In other words, a first rib 31, among the ribs 31, positioned at an upper position than a second rib 31, among the ribs 31, extends longer in the scanning direction than the second rib (second modified embodiment).

As described above, the four tubes 6 are arranged such that a tube 6, among the tubes 6, of which fixed portion 6*a* is positioned more downwardly, is connected to the connecting port 3*c*, among the connecting ports 3*c*, positioned farther from the fixed portion 6*a* in the paper feeding direction. Therefore, the four tubes 6, which are positioned at the more upward positions at the fixed portions 6*a*, are located at the positions disposed more closely to the opposing surface 8*a* over the long distances from the fixed portions 6*a*, and they begin to be separated from the opposing surface 8*a* at the positions separated farther from the fixed portions 6*a*. From the opposite side, the tubes 6, which are positioned more downwardly at the fixed portions 6*a*, begin to be separated from the opposing surface 8*a* at the positions nearer to the fixed portions 6*a*.

Therefore, in the second modified embodiment, the heights of the ribs 31 are approximately same with each other, and the ribs 31, which are positioned more upwardly, have the longer lengths in relation to the scanning direction. Accordingly, the tubes 6, which are positioned more upwardly at the fixed portions 6*a*, can be brought in contact with the corresponding ribs 31 over the long distances from the fixed portions 6*a*. Therefore, it is possible to avoid the upward floating of the tubes 6.

On the other hand, as for the ribs 31 positioned downwardly, the lengths of the portions brought in contact with the tubes 6 are short, even when the lengths in relation to the scanning direction are lengthened. Therefore, when the lengths in relation to the scanning direction are shortened, then useless portions of the ribs 31 can be eliminated, and it is possible to reduce the production cost of the tube guide 8.

In this arrangement, the tubes 6, which are positioned downwardly, have the short lengths to be brought in contact with the ribs 31, and hence they tend to float upwardly with ease. However, even when the tubes 6, which are positioned downwardly, float upwardly, then the tubes 6 are brought in contact with the tubes 6 which are positioned upwardly and which are brought in contact with the ribs 31 over the long distances, and thus the tubes 6 are prevented from floating upwardly any more.

Figure 10:
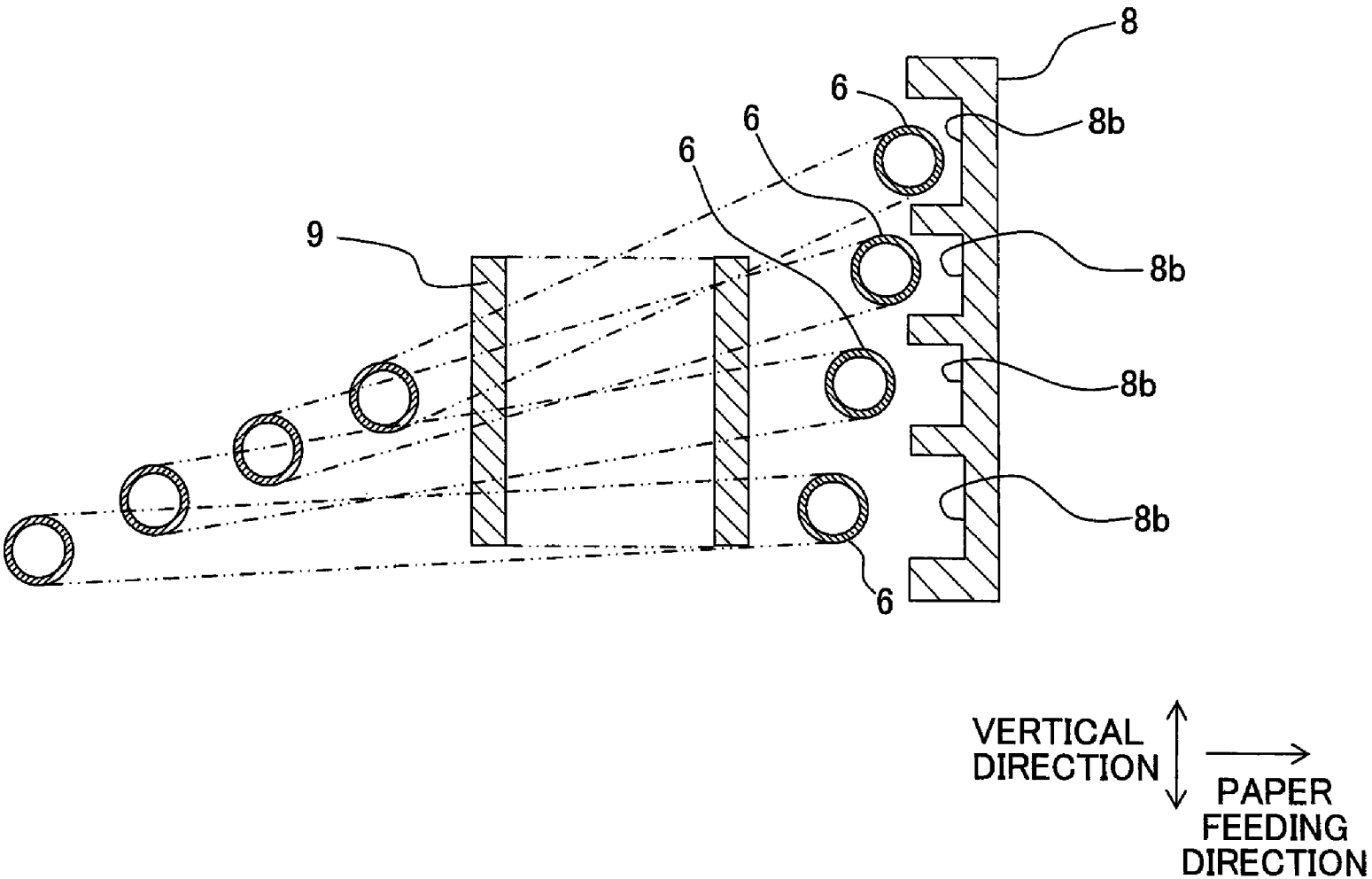
FIG. 10 shows a view of a third modified embodiment corresponding to FIG. 4.
Figure 11:
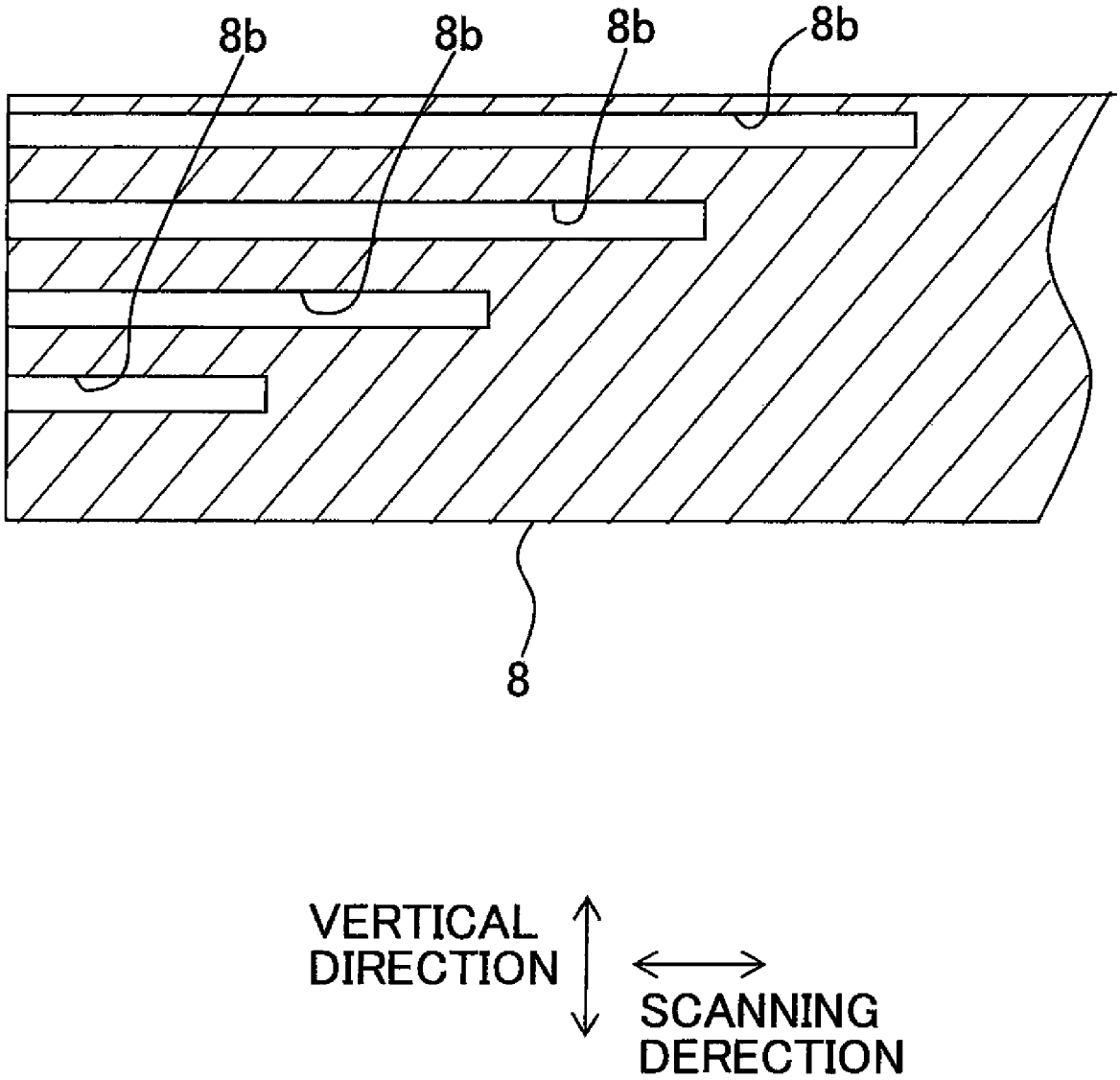
FIG. 11 shows a view of the third modified embodiment corresponding to FIG. 5.

In the embodiment of the present invention, the plurality of accommodating sections are defined by the opposing surface 8*a* of the tube guide 8 and the plurality of ribs 15 allowed to protrude from the opposing surface 8*a*. However, as shown in FIG. 10, it is also allowable to use a plurality of grooves (recesses) which are formed on the tube guide 8. As shown in FIG. 11, a groove 8*b*, among the grooves 8*b*, formed more upwardly is longer in the scanning direction than another groove 8*b* formed below the groove 8*b* (third modified embodiment).

In this case, the tubes 6, which are positioned more upwardly at the fixed portions 6*a*, can be accommodated in corresponding grooves 8*b* over the long distances from the fixed portions 6*a*. Accordingly, it is possible to avoid the upward floating of the tubes 6.

Figure 12:
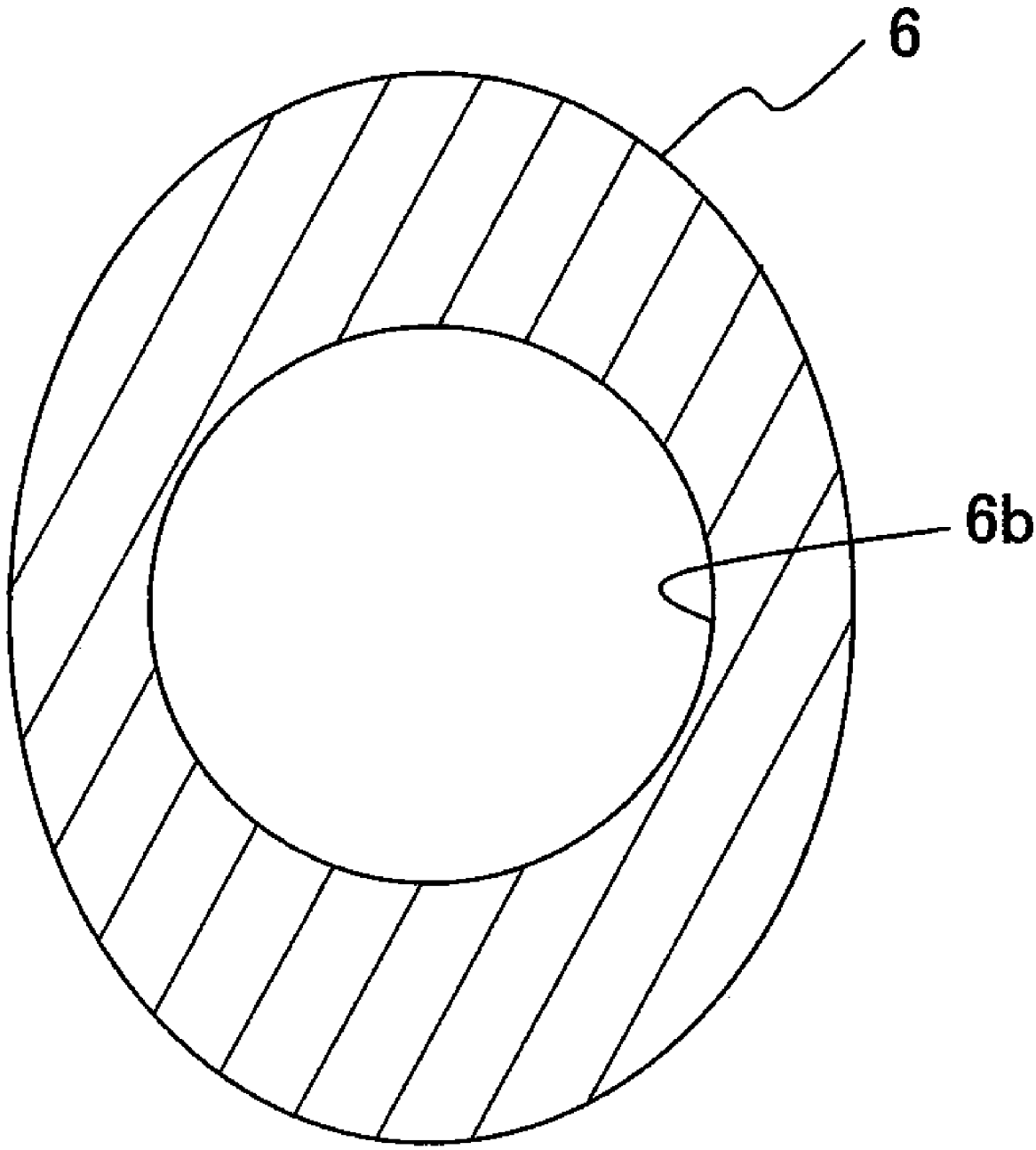
FIG. 12 shows a cross sectional view of a tube of a fourth modified embodiment.

In the embodiment of the present invention, the cross section of the tube 6 is concentric. However, as shown in FIG. 12, the cross section of the tube 6 may have an elliptical external shape and the cross section of the inner space 6*b* of the tube 6 may have a circular shape (fourth modified embodiment).

In this case, wall thickness in the minor axis direction of the elliptical external shape of the tube 6 is thinner than that in the major axis direction. Accordingly, when the tube 6 is arranged such that the major axis direction of the elliptical external shape of the tube 6 is a bending direction of the tube 6, the wall thickness of the tube 6 in the bending direction is thin. Therefore, it is possible to decrease the reaction force of the tube 6 and to avoid the upward floating of the tube 6 more effectively.

In the embodiment of the present invention, the tubes 6, which are positioned more upwardly at the fixed portions 6*a*, are connected to the connecting ports 3*c* which are positioned on the inner circumferential side of the bending of the tubes 6 as viewed in a plan view. However, in contrast thereto, the tubes 6, which are positioned more upwardly at the fixed portions 6*a*, may be connected to the connecting ports 3*c* which are positioned on the outer circumferential side of the bending of the tubes 6 as viewed in a plan view (on the upper side as viewed in FIG. 2).

In this case, reversely to the embodiment of the present invention, the tubes 6, which are positioned more upwardly at the fixed portions 6*a*, are separated more greatly from the opposing surface 8*a*. Therefore, when the ribs 21, which are positioned more upwardly, are formed so that they protrude greatly from the opposing surface 8*a*, it is possible to effectively avoid the upward floating of the tubes 6 and the mutual entanglement of the tubes 6.

In the embodiment of the present invention, the connecting ports 3*c* of the ink-jet head 3 are arranged below all of the fixed portions 6*a*. Alternatively, the connecting ports 3*c* of the ink-jet head 3 are arranged at the same height as that of the fixed portion 6*a* positioned at the lowermost position. However, the connecting ports 3*c* may be arranged over the fixed portion 6*a* positioned at the lowermost position.

Even when the fixed portions 6*a* and the connecting ports 3*c* are in any positional relationship in relation to the vertical direction, at least three of the fixed portions 6*a* are arranged at the heights different from that of the connecting ports 3*c*, on condition that the tubes 6 are arranged in the vertical direction at the fixed portions 6*a* and the connecting ports 3*c* are arranged in the paper feeding direction. The reaction forces, which are generated in the tubes 6, act in the vertical direction, and it is feared that the tubes 6 may float upwardly. However, even in such a situation, it is possible to avoid the upward floating of the tubes 6 and the mutual entanglement of the tubes 6 by individually providing the ribs for the four tubes 6.

In the embodiment of the present invention, the four connecting ports 3*c* of the ink-jet head 3 are arranged in the paper feeding direction perpendicular to the scanning direction (the second direction is the same as the direction which is perpendicular to the first direction and parallel to the predetermined plane). However, the four connecting ports 3*c* may be arranged in the scanning direction. Alternatively, the four connecting ports 3*c* may be arranged in any direction other than the scanning direction and the paper feeding direction on the horizontal plane.

In the foregoing description, each of the ribs has the tapered shape so that the width in relation to the vertical direction is decreased in the direction away from the opposing surface 8*a* at least at the end portions thereof. However, there is no limitation thereto. For example, each of the ribs may have constant width in relation to the vertical direction over the entire portion thereof.

In the foregoing description, the lengths by which the ribs protrude from the opposing surface 8*a* or the lengths of the ribs which relate to the scanning direction are different from each other. However, all of the lengths by which the ribs protrude from the opposing surface 8*a* and the lengths of the ribs which relate to the scanning direction may be same with each other.

In the embodiment of the present invention, the four tubes 6 are provided. However, the number of the tubes 6 may be two, three, or five or more.

In the foregoing description, the exemplary embodiments have been explained, in which the present invention is applied to the printer for performing the printing on the recording paper sheet P by discharging the inks from the nozzles 10 which are moved in the scanning direction together with the carriage 2. However, the present invention is also applicable to any liquid discharge apparatus which is movable in the scanning direction and which discharges any liquid other than the ink from nozzles.

What is claimed is:

1. A liquid discharge apparatus which discharges liquids, comprising:

a liquid discharge head which reciprocates in a first direction on a predetermined plane and which discharges the liquids from nozzles;

liquid supply sources which store the liquids to be supplied to the liquid discharge head;

a plurality of flexible tubes which are arranged in a state of being bent and separated from each other and each of which constructs a part of a liquid flow passage from one of the liquid supply sources to the liquid discharge head; and a regulating member which is arranged on an outer circumferential side of the bent tubes and which regulates a movement of the tubes, wherein a plurality of connecting ports, of the liquid discharge head, to which first ends of the flexible tubes are connected respectively, are arranged in a second direction on the predetermined plane;

wherein the tubes are fixed to the liquid discharge apparatus at fixed portions of the tubes in a state that the tubes are arranged in a third direction intersecting the predetermined plane, the fixed portions being located at positions different from positions of the connecting ports of the liquid discharge head in relation to a direction which is perpendicular to the first direction and parallel to the predetermined plane;

wherein the regulating member has a plurality of accommodating sections each of which accommodates one of the flexible tubes; and wherein the accommodating sections are defined by an opposing surface which extends in the first and third directions, and which is opposed to portions of the flexible tubes extending from the fixed portions toward the first ends, and a plurality of ribs which protrude from the opposing surface.

2. The liquid discharge apparatus according to claim 1;

wherein each of the fixed portions is formed in one of the tubes at an intermediate portion thereof.

3. The liquid discharge apparatus according to claim 1;

wherein the fixed portions are fixed to the regulating member.

4. The liquid discharge apparatus according to claim 1;

wherein the opposing surface regulates the movement of the tubes in the direction perpendicular to the first direction on the predetermined plane, and the ribs regulate the movement of the tubes in the third direction.

5. The liquid discharge apparatus according to claim 1;

wherein each of the tubes has a cross section which is perpendicular to an extending direction of the tube and which has an elliptical external shape and a circular internal shape.

6. The liquid discharge apparatus according to claim 1, further comprising a fixing member which fixes the fixed portions of the tubes to the liquid discharge apparatus.

7. The liquid discharge apparatus according to claim 1;

wherein the third direction is a vertical direction;

wherein the connecting ports of the liquid discharge head are arranged at positions same as or below one of the tubes positioned on a lowermost side in the vertical direction at the fixed portion;

wherein the tubes are arranged such that a first tube, among the tubes, of which fixed portion is positioned at an upper position in the vertical direction than that of a second tube, among the tubes, is connected to a first connecting port, among the connecting ports, of the liquid discharge head, positioned nearer to the fixed portions than a second connecting port, among the connecting ports, to which the second tube is connected; and wherein the ribs are formed such that a first rib, among the ribs, positioned at an upper position in the vertical direction than a second rib, among the ribs, extends longer in the first direction than the second rib.

8. The liquid discharge apparatus according to claim 1;

wherein the third direction is a vertical direction;

wherein the connecting ports of the liquid discharge head are arranged at positions same as or below one of the tubes positioned on a lowermost side in the vertical direction at the fixed portion;

wherein the tubes are arranged such that a first tube, among the tubes, of which fixed portion is positioned at an upper position in the vertical direction than that of a second tube, among the tubes, is connected to a first connecting port, among the connecting ports, of the liquid discharge head, positioned nearer to the fixed portions than a second connecting port, among the connecting ports, to which the second tube is connected; and wherein the ribs are formed such that a first rib, among the ribs, positioned at a lower position in the vertical direction than a second rib, among the ribs, protrudes more greatly from the opposing surface than the second rib.

9. The liquid discharge apparatus according to claim 1;

wherein each of the ribs has a tapered shape at end portion thereof such that a width of the rib in the third direction is decreased in a direction away from the opposing surface.

10. The liquid discharge apparatus according to claim 9;

wherein each of the ribs has a constant width in the third direction at a portion different from the end portion.

11. The liquid discharge apparatus according to claim 1;

wherein each of the ribs has an end portion having a curved shape.

12. The liquid discharge apparatus according to claim 1;

wherein the tubes have same lengths.

13. The liquid discharge apparatus according to claim 1;

wherein the tubes extend in the first direction from the first ends and each of the tubes is bent back in a U-shape at an intermediate portion thereof.

14. A liquid discharge apparatus which discharges liquids, comprising:

a liquid discharge head which reciprocates in a first direction on a predetermined plane and which discharges the liquids from nozzles;

liquid supply sources which store the liquids to be supplied to the liquid discharge head;

a plurality of flexible tubes which are arranged in a state of being bent and separated from each other and each of which constructs a part of a liquid flow passage from one of the liquid supply sources to the liquid discharge head; and a regulating member which is arranged on an outer circumferential side of the bent tubes and which regulates a movement of the tubes, wherein a plurality of connecting ports, of the liquid discharge head, to which first ends of the flexible tubes are connected respectively, are arranged in a second direction on the predetermined plane;

wherein the tubes are fixed to the liquid discharge apparatus at fixed portions of the tubes in a state that the tubes are arranged in a third direction intersecting the predetermined plane, the fixed portions being located at positions different from positions of the connecting ports of the liquid discharge head in relation to a direction which is perpendicular to the first direction and parallel to the predetermined plane;

wherein the regulating member has a plurality of accommodating sections each of which accommodates one of the flexible tubes; and wherein each of the accommodating sections is a recess which is formed on the regulating member.

* * * * *